US005201678A

United States Patent [19]

Venezia

[11] Patent Number: 5,201,678

[45] Date of Patent: Apr. 13, 1993

[54] SET SCREW BUS CONNECTOR

[75] Inventor: J. William Venezia, Orlando, Fla.

[73] Assignee: Homac Mfg. Company, Ormond Beach, Fla.

[21] Appl. No.: 788,675

[22] Filed: Nov. 6, 1991

[51] Int. Cl.[5] ..... H01R 11/09

[52] U.S. Cl. ..... 439/723; 439/736; 439/798

[58] Field of Search ..... 439/721, 723, 724, 798, 439/797, 796, 814

[56] References Cited

U.S. PATENT DOCUMENTS

| | | | |
|---|---|---|---|
| D. 195,623 | 7/1963 | Leonardo | D26/1 |
| 2,909,757 | 10/1959 | Speck | 439/723 |
| 2,917,724 | 12/1959 | Jackson | 439/721 |
| 3,047,835 | 7/1962 | Kelly | 439/798 |
| 3,133,779 | 5/1964 | Stanback | 339/242 |
| 3,191,139 | 6/1965 | Schiffmann | 339/97 |
| 3,399,270 | 8/1968 | Stoddard | 174/90 |
| 3,605,067 | 9/1971 | Szabo et al. | 439/798 |
| 3,725,851 | 4/1973 | Linn | 439/798 |
| 3,727,171 | 4/1973 | Coles et al. | 439/796 |
| 3,760,341 | 9/1973 | Grad | 339/265 F |
| 3,876,279 | 4/1975 | Underwood | 339/272 UC |
| 4,050,770 | 9/1977 | Rigo | 439/724 |
| 4,778,412 | 10/1988 | Walter et al. | 439/798 |

FOREIGN PATENT DOCUMENTS

| | | | |
|---|---|---|---|
| 0311537 | 4/1989 | European Pat. Off. | 439/798 |
| 1270059 | 7/1961 | France | 439/721 |

*Primary Examiner*—Larry I. Schwartz
*Assistant Examiner*—Hien D. Vu
*Attorney, Agent, or Firm*—John E. Benoit

[57] ABSTRACT

A set screw bus connector comprising a bus with a secondary outlet and a service outlet extending from the bus. The service outlet comprises a terminal having a first borehole extending from its distal end to the bus, a first set screw in the terminal for securing a service cable in the first borehole, a second smaller borehole extending from the distal end of the terminal substantially parallel to but displaced from the first borehole, with the second borehole terminating short of the first set screw, and a second set screw in the terminal for securing a streetlight cable within the second borehole.

2 Claims, 1 Drawing Sheet

SET SCREW BUS CONNECTOR

The present invention relates generally to set screw bus connectors and more specifically to set screw bus connectors adapted for use with service cables and streetlight cables.

BACKGROUND OF THE INVENTION

At the present time, bus connectors have cable outlets which are designed to accept streetlight-size wire under the main conductor. While this concept works well in many cases and performs the desired function, problems are presented using this particular type of connector. In some cases, in order to accommodate the streetlight wire, the main conductor must be reduced in size when introducing a large streetlight wire. Further, when the streetlight wire is added or removed at a later date, the installer must de-energize, remove, and in some cases change the main conductor wire to work on the streetlight wire. This operation is time consuming and, therefore, adds to the cost of maintenance and repair.

Accordingly, the present invention provides a cable outlet comprising a terminal which includes a separate streetlight borehole, including a set screw above the main outlet borehole. Thus, the streetlight wire may be independently inserted in and removed from its own borehole without disturbing or making any adjustment to the main conductor wire.

The invention will be more clearly understood from the following description taken together with the drawings.

BRIEF SUMMARY OF THE INVENTION

The present invention provides a set screw bus connector comprising a bus with a secondary outlet and at least one service outlet extending from the bus. The service outlet comprises an elongated terminal having a first borehole extending from its distal end toward the bus and a first set screw in the terminal for securing a service cable in the first borehole. The terminal includes a second small borehole above the first borehole extending from the distal end of the terminal substantially parallel to but displaced from the first borehole, with the second borehole terminating short of the first set screw, and a second set screw in the terminal extending into the second borehole for securing a streetlight cable within the second borehole. The length of the elongated terminal providing the service outlet extending from the bus is greater than the length of the terminal extending from the bus for the secondary cable.

DETAILED DESCRIPTION OF THE PREFERRED EMBODIMENT

Figure 1:
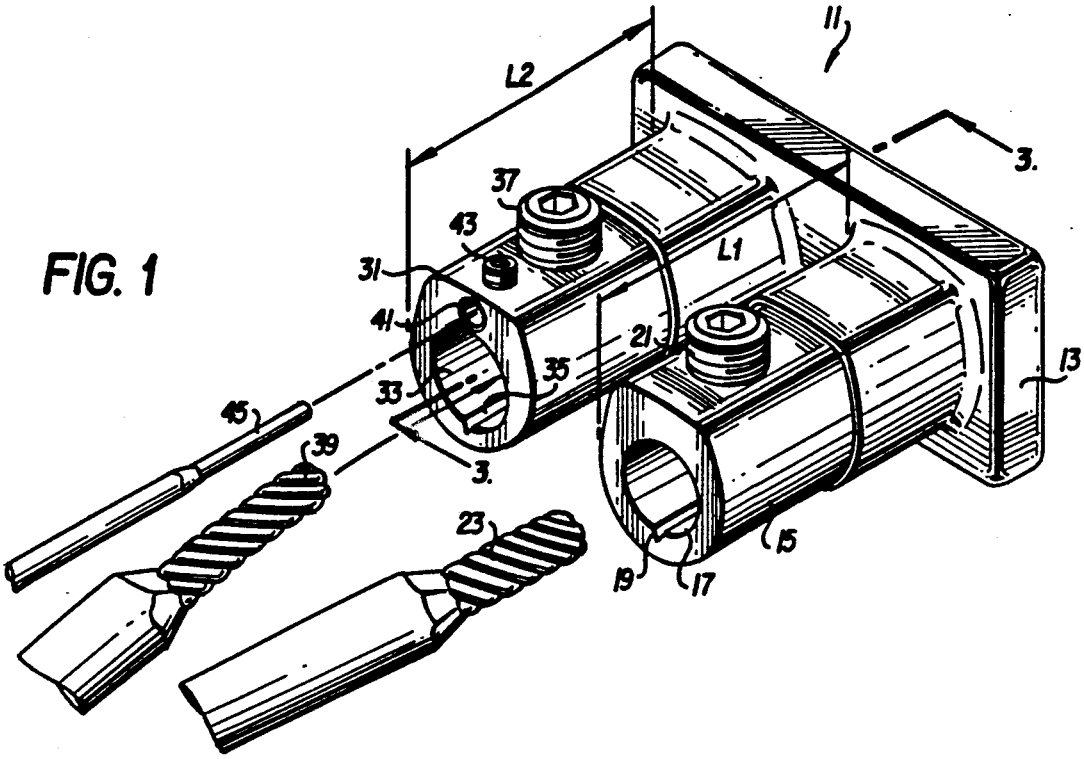
FIG. 1 is a perspective view showing the terminal of the present invention together with a bus, standard terminal, and cables.

Referring to FIG. 1, there is shown set screw bus connector 11 comprising bus 13, first elongated terminal 15, and second elongated terminal 31 extending substantially perpendicular therefrom. Terminal 15 includes borehole 17 for providing the secondary cable outlet.

As indicated, cable 23 is inserted into borehole 17 and secured by means of set screw 21. In this particular configuration, cable 23 represents the secondary cable supplying the input to the set screw bus connector.

Terminal 31 includes borehole 33 for providing a main service cable outlet. Notch 35 has been used in the past for centering and holding a streetlight cable beneath and in contact with the service cable 39. The notch may be incorporated in terminal 31 or may be eliminated, depending upon the particular desires of the purchaser.

Figure 2:
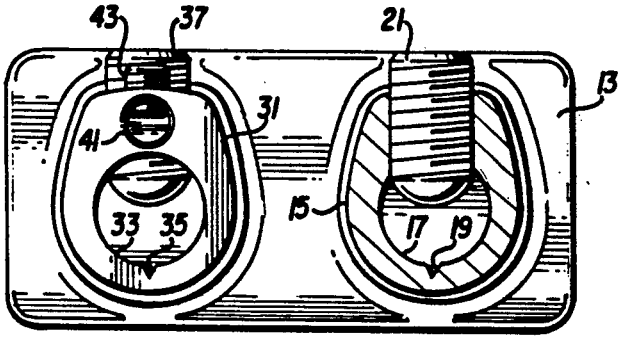
FIG. 2 is an end view of the two terminals and bus of FIG. 1.

As indicated, smaller borehole 41 extends into terminal 31 and is designed to accept streetlight cable 45. With the configuration as shown, the installer has the option of either placing the streetlight cable above notch 35 or within borehole 41. Cable 39 is secured by means of set screw 37, while streetlight cable 45 is secured by means of set screw 43. FIG. 2 discloses an end view of the set screw bus connector of FIG. 1, and FIG. 3 is a sectional view taken through the lines 3—3 of bus 13 and terminal 31.

Figure 3:
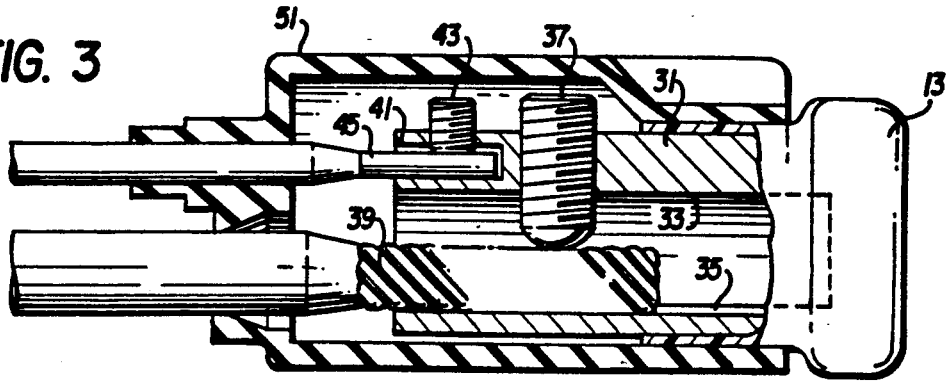
FIG. 3 is a sectional view taken through the lines 3–3 of FIG. 1.

As can be seen in FIGS. 2 and 3, borehole 41 is substantially parallel to and offset from borehole 33. Referring to FIG. 3, it can be seen that set screw 37 extends into borehole 33. Under standard procedures, cable outlets formed by terminals 15 and 31 are cut from a length of precast material and welded to bus bar 13. Thus, notch 19 appears in terminal 15. In the drawings there is also shown an insulating coating about the bus bar and part of each of the two terminals.

Before welding, borehole 41 is bored into terminal 31 above borehole 33. As can be seen in FIG. 3, borehole 41 terminates short of set screw 37 and is provided with its own set screw 43, which is located between set screw 37 and the distal end of terminal 31.

In order to allow proper securing of a desired length of streetlight cable 45 into borehole 41, the length L2 of terminal 31 is greater than the length L1 of terminal 15.

Again referring to FIG. 3, the final connected service cable 39 and streetlight cable 45 are shown as protected by a watertight cover 51, which surrounds both cables and the insulation about the inner part of terminals 15 and 31.

As indicated above, the provision of a separate outlet for a streetlight cable allows the cable to be serviced separately from the main service cable without disturbing the main service cable. The advantages of such an arrangement are obvious and have been well received in the utility community.

The above description and drawings are illustrative only since modifications could be made without departing from the invention, the scope of which is to be limited only by the following claims.

I claim:

1. A set screw bus connector for use with electric cables comprising a bus;

at least one secondary outlet means extending outwardly from and substantially perpendicular to said bus;

at least one service outlet means extending outwardly from and substantially perpendicular to said bus, said service outlet means comprising a rigid elongated terminal;

a first borehole in said terminal extending from the distal end of said terminal substantially perpendicular to said bus;

a first set screw means extending through said terminal and into said first borehole for securing a service cable within said first borehole;

a second borehole in said terminal extending from the distal end of said terminal substantially parallel with and adjacent to said first borehole, said second borehole having a substantially smaller diameter than said first borehole and terminating within said terminal short of said first set screw means;

second set screw means extending through said terminal and into said second borehole for securing a streetlight cable within said second borehole, said second set screw means being between said first set screw means and said distal end of said terminal; and a single watertight cover surrounding said terminal and adapted for providing a watertight fit with both a service cable and a streetlight cable.

2. The connector of claim 1 wherein said service outlet means has a length greater than said secondary outlet means.

* * * * *